US005463813A

United States Patent [19]

Otsuka et al.

[11] Patent Number: 5,463,813

[45] Date of Patent: Nov. 7, 1995

[54] RECIPROCATORY DRY SHAVER

[75] Inventors: Kiyotaka Otsuka, Hikone; Jyuzaemon Iwasaki, Nagahama, both of Japan

[73] Assignee: Matsushita Electric Works, Ltd., Osaka, Japan

[21] Appl. No.: 148,566

[22] Filed: Nov. 8, 1993

[30] Foreign Application Priority Data

Nov. 13, 1992 [JP] Japan ..... 4-303388

[51] Int. Cl.[6] ..... B26B 19/04; B26B 19/12

[52] U.S. Cl. ..... 30/43.9; 30/49

[58] Field of Search ..... 30/43.9, 43.92, 30/49, DIG. 2, 346.5

[56] References Cited

U.S. PATENT DOCUMENTS

| | | | |
|---|---|---|---|
| 2,282,639 | 5/1942 | Bruecker | 30/43.9 |
| 2,284,038 | 5/1942 | Bruecker | 30/43.9 X |
| 2,559,772 | 7/1951 | Kobler et al. | 30/43.92 |
| 2,562,104 | 7/1951 | Kobler et al. . | |
| 4,428,117 | 1/1984 | Horii et al. | 30/43.9 X |

FOREIGN PATENT DOCUMENTS

| | | |
|---|---|---|
| 171778 | 12/1951 | Austria . |
| 4128587 | 3/1992 | Germany . |

*Primary Examiner*—Rinaldi I. Rada

*Attorney, Agent, or Firm*—Stevens, Davis, Miller & Mosher

[57] ABSTRACT

A dry shaver includes a housing mounting thereon a cutter head which comprises a perforated outer shearing foil and an inner cutter. The outer shearing foil has a first axis along which it is arcuately curved. The inner cutter has a longitudinal axis along which it is arcuately curved to have an arcuate contour in conformity with the outer shearing foil. Projecting from the housing is a drive arm which is connected to reciprocate the inner cutter along a reciprocation path parallel to the first axis in hair shearing engagement with the outer shearing foil so that the inner cutter moves to and fro between two end positions spaced along the reciprocation path and defining therebetween a central position. A spring is provided to floatingly support the inner cutter to the drive arm for biasing the inner cutter against the outer shearing foil. The inner cutter is configured to satisfy the following relation that 0.5<R2/R1<1, wherein R1 is a radius of curvature of the outer shearing foil, and R2 is a distance between the pivot axis of the drive arm and a point at which an upper end of said inner cutter in said neutral position is in contact with said outer shearing foil, whereby said spring exerts a lower biasing force to the inner cutter when the inner cutter moves toward the end position than at the neutral position.

7 Claims, 11 Drawing Sheets

X
Y
Y
X
30
31
32

42
41
40
43
42
52
52
50
51
56
57
55
23
28
27
24
27
22
29
28
21
25

90
91
90
110
111
100
101
91
92
94
110
100
94
92
84
83
81
84
81
88
89
80
87
86
82
88
88
87
85
82
83
87
89

RECIPROCATORY DRY SHAVER

BACKGROUND OF THE INVENTION

1. Field of the Invention

The present invention is directed to a reciprocatory dry shaver, and more particular to a dry shaver having an outer shearing foil curved into an arcuate curvature and an inner cutter reciprocating along an arcuate curvature in hair shearing engagement with the outer shearing foil.

2. Description of the Prior Art

Such dry shavers having an arcuate outer shearing foil and an inner cutter reciprocating along the arcuate curvature of the outer shearing foil have been provided for shaving complicated areas such as chin or underarms, as disclosed in the art, for instance, in Japanese Patent Publication JP-B2 57-53748, Japanese Utility Model Early Publication JP-A1 50-3788, and Japanese Patent Publication JP-B2 53-28817. In the shaver of this type, a bias spring is utilized to bias the inner cutter against the arcuately curved outer shearing foil to give a necessary contacting pressure therebetween for shaving. However, there is a potential problem that, when the inner cutter moves along the outer shearing foil towards opposite end positions from a central or neutral position of reciprocation, the inner cutter is likely to get entangled at its leading end with the outer shearing foil due to the fact that the inner cutter moves more slowly towards the end positions than at the central position. Consequently, the trailing end of the inner cutter comes readily out of contact with the outer shearing foil, thereby failing to ensure smooth shaving and correspondingly lowering shaving efficiency. In order to avoid this problem, the prior shaver is limited to have a relatively large radius of curvature for the outer shearing foil. That is, the prior shaver is difficult to design to have a large curvature (small radius of curvature) sufficient for intimate contact with the local concave or convex areas in the skin of the user, while at the same time assuring smooth and constant shearing engagement between the inner cutter and the outer shearing foil.

SUMMARY OF THE INVENTION

The above problem has been eliminated in the present invention which provides an improved dry shaver which is capable of being designed to give increased curvature of the arcuate outer shearing foil and the inner cutter for intimate contact with locally convex or concave areas in the user's skin such as chin and underarms, yet enabling reciprocation of the inner cutter along the arcuate outer shearing foil smoothly without the inner cutter being entangled or jammed against the outer shearing foil. Therefore, it is possible with the improved shaver of the present invention to shave the chin and underarms successfully with enhanced shaving efficiency. The dry shaver in accordance with the present invention includes a housing mounting thereon a cutter head which comprises a perforated outer shearing foil and an inner cutter. The outer shearing foil has a first axis along which it is arcuately curved. The inner cutter has a longitudinal axis along which it is arcuately curved to have an arcuate contour in conformity with the outer shearing foil. Projecting from the housing is a drive arm which is connected to reciprocate the inner cutter along a reciprocation path parallel to the first axis in hair shearing engagement with the outer shearing foil so that the inner cutter moves to and fro between two end positions spaced along the reciprocation path and defining therebetween a central position. A spring is provided to floatingly support the inner cutter to the drive arm for biasing the inner cutter against the outer shearing foil. The spring exerts less biasing force to the inner cutter when the inner cutter moves to the end position than at the center position. With this arrangement, the biasing force decreases as the inner cutter moves away from the central position toward the end position with a correspondingly decreasing speed, and therefore balances with the decreasing speed of the inner cutter such that the inner cutter moving to the end positions is well prevented from being jammed with the outer shearing foil, while the inner cutter receiving a greater biasing force around the central position can be kept free from the jamming as the inner cutter moves faster therearound with an increased speed which compensates for the greater biasing force. Further, the inner cutter is configure to satisfy the following relation:

$$0.5<R2/R1$$

wherein R1 is a radius of curvature of the outer shearing foil, and R2 is a distance between the pivot axis of the drive arm and a point at which an upper end of the inner cutter in the neutral position is in contact with the outer shearing foil.

The above relation is found experimentally to be essential for smoothly sliding the inner cutter along the arcuate outer shearing foil, particularly, in the direction of moving the inner cutter from the end positions to the neutral position. When R2 is selected to be considerably less than R1, i.e., the upper end of the drive arm traces the correspondingly arcuate path having a radius considerably less than R1, the drive force acting along a tangent of the correspondingly greater curvature for moving the inner cutter towards the neutral position is also applied to the outer shearing foil at a greater angle, thereby unduly increasing the friction between the inner cutter and the outer shearing foil or even damaging the blades and the foil. It has been experimentally found that the above relation $R2/R1>0.5$ is essential for assuring smooth sliding movement of the inner cutter from the end positions to the neutral position, in addition to the movement from the neutral position to the end positions.

The drive arm is configured to have an upper end connected to the inner cutter and is pivotally supported at a portion downwardly of the upper end to define thereat a pivot axis extending perpendicular to the reciprocation path. The drive arm is connected to a drive source at its lower end so as to oscillate about the pivot axis. The pivot axis is selected so that the upper end of the drive arm traces an arcuate path of a circle which has a radius smaller than a radius of curvature of the outer shearing foil. Whereby the upper end of the drive arm deviates by a greater extent from the outer shearing foil as the drive arm pivots to two opposite angularly displaced positions. Therefore, the spring become less compressed to exert a smaller biasing force for the inner cutter as the drive arm pivots to have the upper end advancing to the angularly displaced positions.

The inner cutter comprises a plurality of inner blades which are spaced along the longitudinal axis of the inner cutter in such a manner that the individual edges of the blades cooperate to define the arcuate contour of the inner cutter. In order to further assure smooth contacting engagement between the inner cutter and the outer shearing foil, it is contemplated that a length (B) and a height (H) of the inner cutter are determined to satisfy the following relation:

$$H/B<0.3$$

wherein the length (B) is a distance from one to the other of outermost inner blades and the height (H) is a distance from an upper end of the outermost inner blade to a drive point at which the drive arm transmits a drive force for reciprocating the inner cutter.

In order to achieve the above relation, the drive point is defined upwardly of a connection point at which the inner cutter is connected to the drive arm. The above relation is further and readily achieved by providing the drive point upwardly of a contact point at which a lower end of the edge of the outermost inner blade contacts with the outer shearing foil.

These and still other objects and advantageous features of the present invention will become more apparent from the following detailed description of the embodiment of the invention when taken in conjunction with the attached drawings.

DETAILED DESCRIPTION OF THE EMBODIMENT

Figure 1:
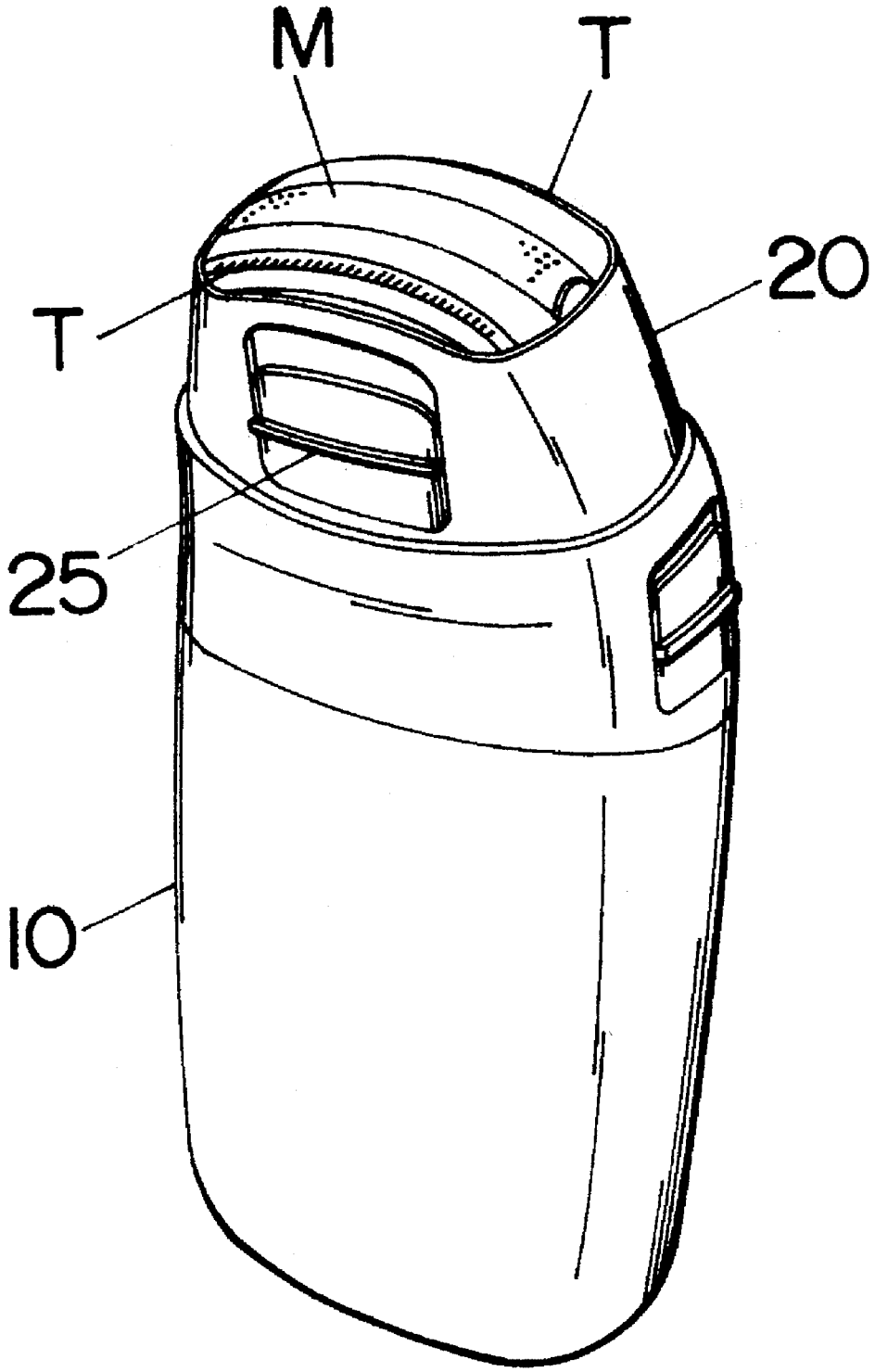
FIG. 1 is a perspective view of a dry shaver in accordance with a preferred embodiment of the present invention.
Figure 2:
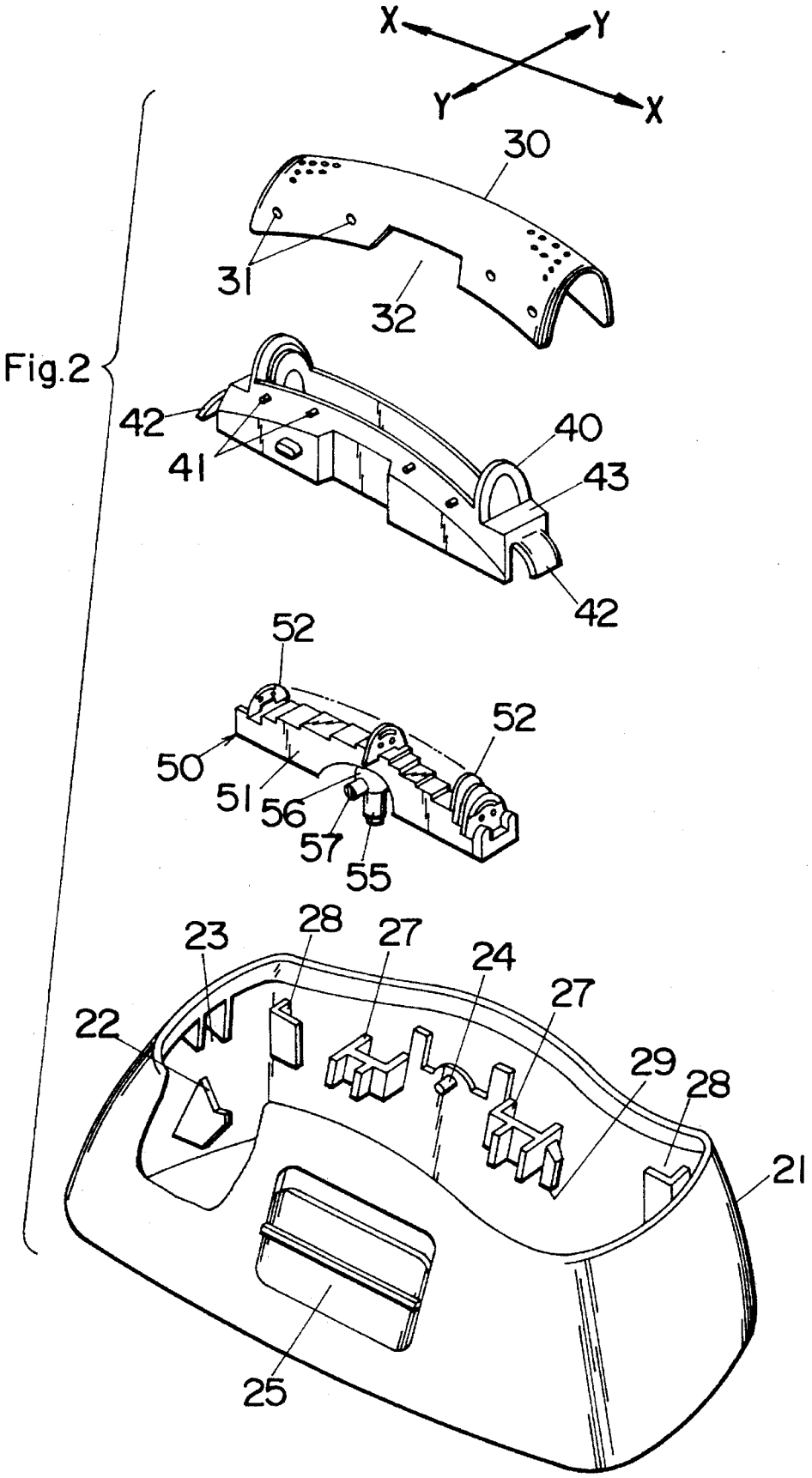
FIG. 2 is an exploded perspective view of a cutter head of the shaver.
Figure 3:
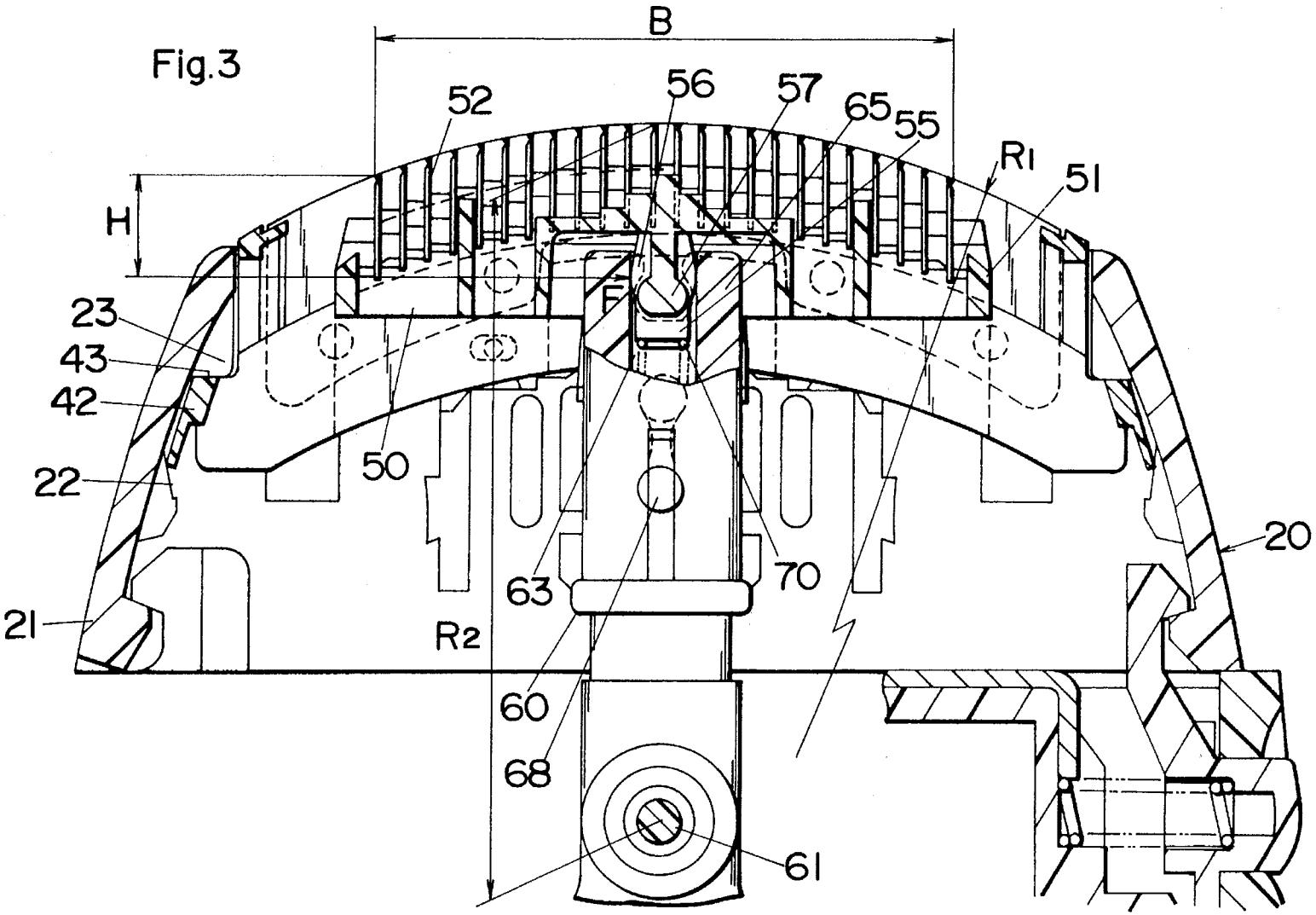
FIG. 3 is a front sectional view of the cutter head.
Figure 4:
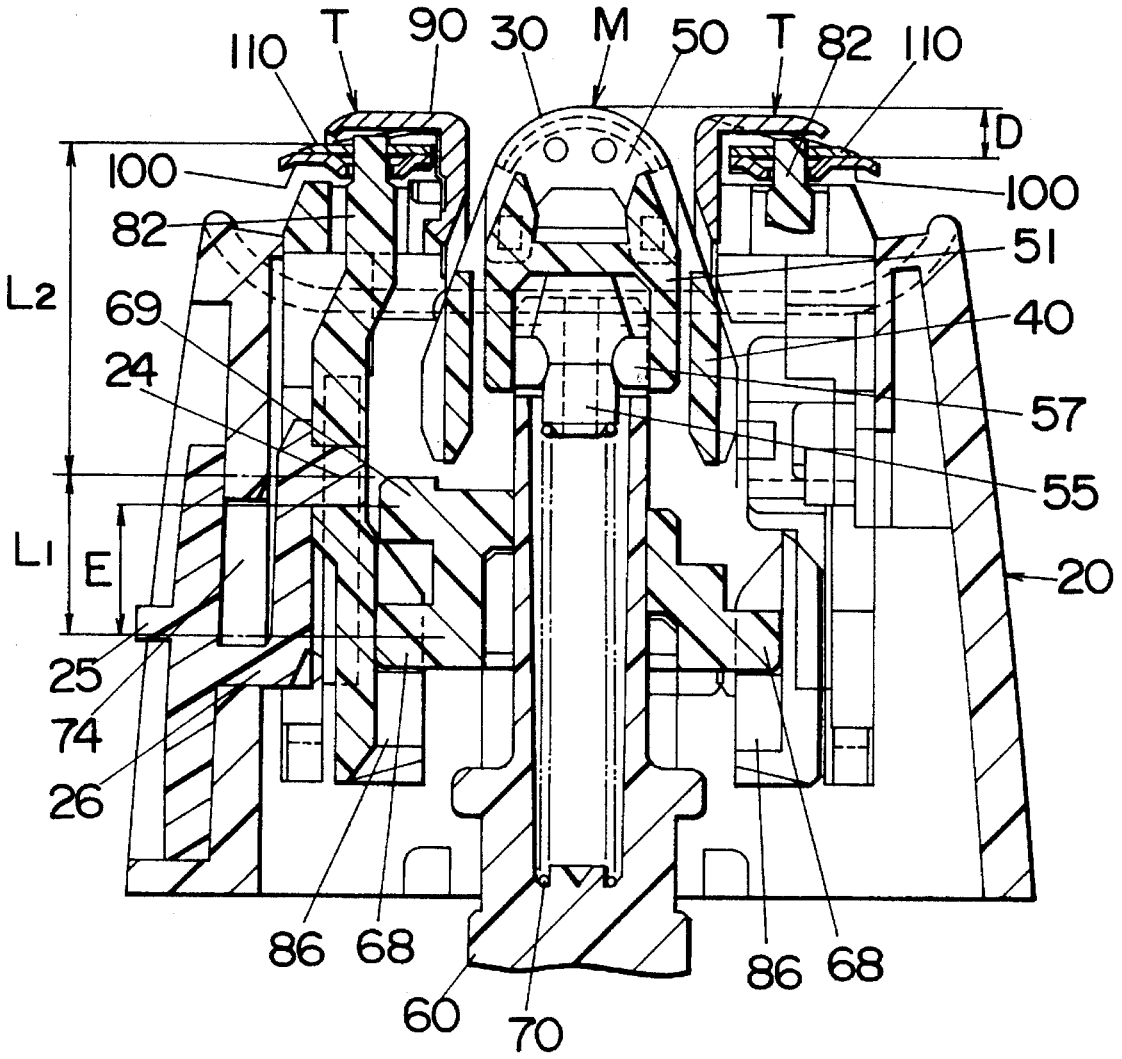
FIG. 4 is a side sectional view of the cutter head.

Referring now to FIG. 1, there is shown a dry shaver in accordance with a preferred embodiment of the present invention. The shaver comprises a housing 10 mounting thereon a detachable cutter head 20 which includes a main cutter M and a pair of trimmers T. As shown in FIGS. 2 to 4, the main cutter 1 comprises an outer shearing foil 30 with a number of perforations and an inner cutter 50. The trimmers T are each configured to comprise a toothed stationary blade 100 and a toothed movable blade 110. A drive arm 60 projects from the housing 10 into the cutter head 20 and connected to reciprocate the inner cutter 40 as well as the movable blades 110 in hair shearing engagement respectively with the outer shearing foil 30 and the stationary blades 100. The housing 10 incorporates an electric motor 11 which is connected to the drive arm 60 through a rotary-to-oscillatory conversion mechanism for reciprocating the inner cutter 50 and the blades 110.

As shown in FIG. 2, the cutter head 20 comprises a top-opened generally rectangular head frame 21 mounting a plastic holder 40 for the outer shearing foil 30 and the trimmers T on the opposite sides thereof. The outer shearing foil 30 is arcuately curved along its longitudinal axis X in addition to along an axis Y perpendicular to the longitudinal axis X but with differing curvatures so that the outer shearing foil 30 has along the X-axis an arcuate cross section of larger radius of curvature than an arcuate cross section along the Y-axis. The holder 40 is formed on its side walls with a plurality of studs 41 which are longitudinally spaced along an arcuate path and engage into corresponding holes 31 in the lateral sides of the outer shearing foil 30, respectively, to support the arcuately curved outer shearing foil 30. The studs 41 on the longitudinal ends of the holder 40 are swelled by application of heat so as to be fixed to the corresponding holes 31, while the remaining center studs 41 are left unfixed in order that the outer shearing foil 30 is held to have a uniform radius R1 of curvature. For the same purpose, the outer shearing foil 30 is formed in the center of the lateral sides with cut-outs 32. Formed at the longitudinal ends of the holder 40 are resilient legs 42 which depend downwardly and outwardly and abut at the respective lower ends against cam surfaces of projections 22 on the interior of the head frame 20, as best shown in FIG. 3, in such a manner that the holder 40 is urged upwardly to a position where shoulders 43 formed adjacently of the upper end of the legs 42 are seated against corresponding stops 23 formed on the interior of the head frame 21 upwardly of the projection 22. Thus, the holder 40 can be readily assembled into the head frame 21 through a bottom opening of the head frame 21 and held stably thereto.

Figure 5:
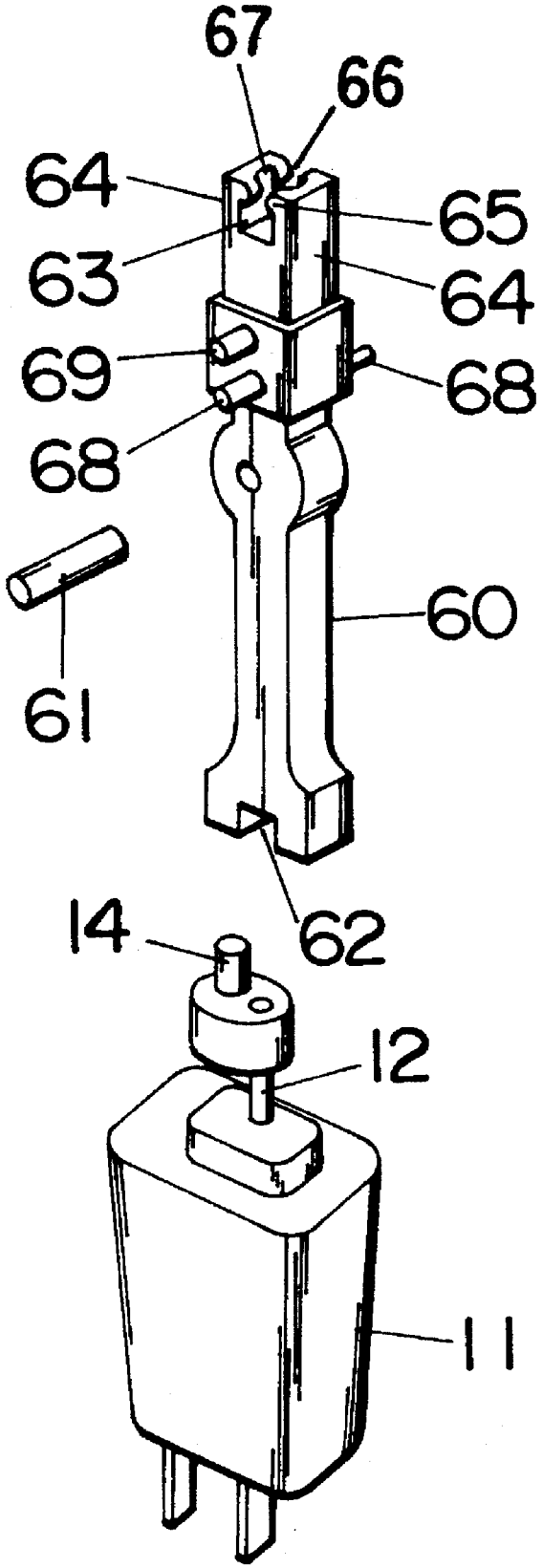
FIG. 5 is an exploded perspective view illustrating a drive arm and a motor utilized in the dry shaver for reciprocating an inner cutter of the cutter head.

The inner cutter 50 comprises a rectangular base 51 on which a plurality of blades 52 are mounted to be evenly spaced longitudinally. Each blade 52 has an arcuate edge in conformity with the curvature of the outer shearing foil 30 along the Y-axis, while the blades 52 are arranged such that the arcuate edges thereof defines an arcuate contour in conformity with the curvature of the outer shearing foil 30 along the X-axis. Thus constructed inner cutter 50 is driven by the drive arm 60 to reciprocate along the X-axis in hair shearing engagement between the blades 52 and the outer shearing foil 30. As shown in FIGS. 3 and 5, the drive arm 60 is pivotally supported at an intermediate portion to the housing 10 by means of a pivot pin 61 and is coupled to the inner cutter 50 at its upper ends and to an eccentric pin 14 of the motor 11 at its lower end. The eccentric pin 14 is coupled to an output shaft 12 of the motor 11 in an eccentric relation and is engaged loosely into a slot 62 in the lower end of the drive arm 60 so that the drive arm 60 pivots about the pin 61 as the motor 11 is energized to rotate the eccentric pin 14 about the output shaft 12. Formed in the upper end of drive arm 60 is a longitudinally extending groove 63 which defines a pair of jaws 64 on the opposite sides thereof. Formed respectively at the upper end of the jaws 64 are lips 65 which extends inwardly toward each other to define therebetween a constricted opening 66 and which are each formed in its center with a recess 67. The drive arm 60 is also formed with a pair of first pins 68 projecting coaxially and parallel with the pivot pin 61 on the opposite faces of the arm 60 and with a second pin 69 projecting on the one face of the arm 60 in parallel with and upwardly of the first pin 68.

Figure 6:
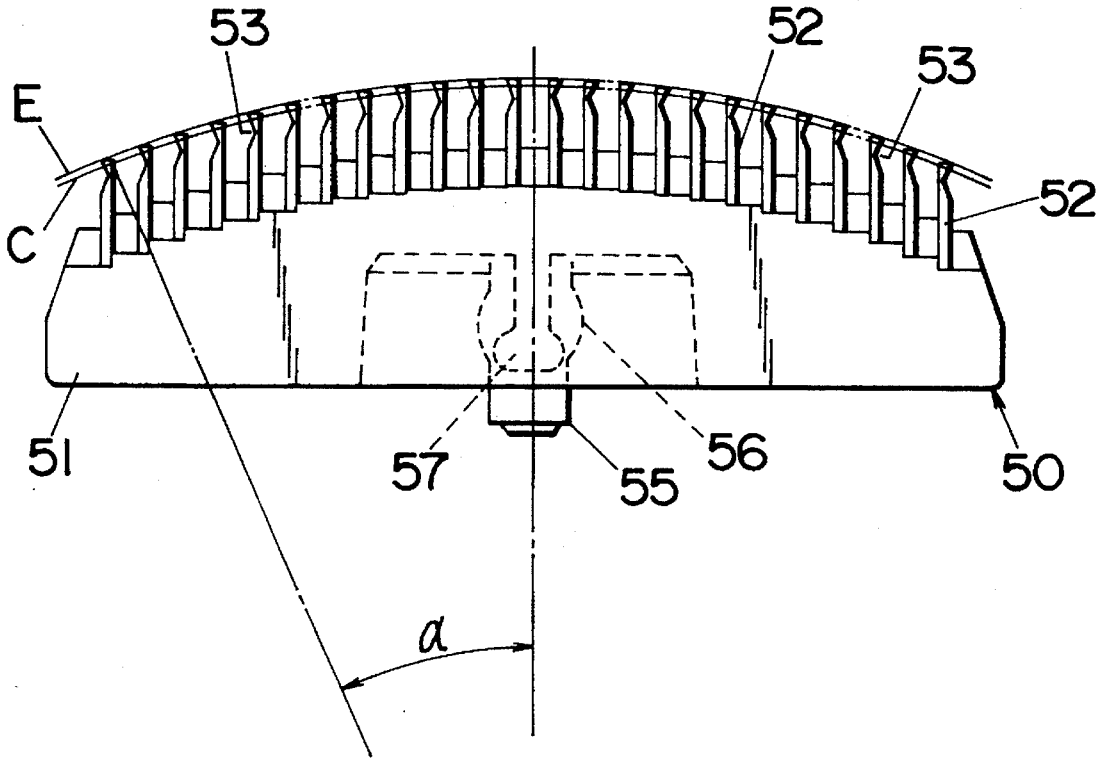
FIG. 6 is sectional view of the inner cutter.

As seen in FIGS. 2 and 6, the inner cutter 50 includes a stem 55 which depends downwardly from the center of the base 51 for connection to the drive arm 60. The stem 55 is formed at its upper end with a swell 56 which fits into the recesses 67 of the lips 65 at the upper end of the drive arm 60 after the stem 50 is inserted into the groove 63 of the drive arm 60. Integrally formed with the stem 55 is an axle 57 which projects horizontally along the Y-axis in opposite directions from a portion just below the swell 56 and which is slidable engaged into the groove 63 so that the inner cutter 50 is slidable along the length of the drive arm 60 within a limited distance. The inner cutter 50 is assembled to the drive arm 60 by forcing the axle 57 into the groove 63 by resiliently flexing the jaws 54 outwardly, after which the jaws 54 close so that the axle 57 is retained in the groove 63 by engagement of the axle 57 to the lower end of the lips 65. A coil spring 70 is fitted in the groove 63 to be compressed between the bottom of the groove 63 and the lower end of the stem 55 so that the inner cutter 50 is urged upwardly against the outer shearing foil 30 until the axle 57 engages with the lower end of the lips 65. Thus, the inner cutter 50 is floatingly supported to the drive arm 60 so as to be movable along the longitudinal direction of the drive arm 60, while at the same time the inner cutter 50 is tiltable within a limited angular range within a plane including the X-axis.

The pivot pin 61 of the drive arm 60 is disposed at a position such that, as the drive arm 60 pivots, the upper end of the drive arm 60 traces an arc of a curvature which is spaced by a greater extent from the outer shearing foil 30 when the drive arm 60 moves towards its angularly displaced end positions than at a neutral position of FIG. 3. That is, as the drive arm 60 moves from the neutral position to either of the end positions, the stem 55 of the inner cutter 50 is allowed to move outwardly within the groove 63 by the coil spring 70 with the attendant slackening of the coil spring 70. Whereby, the inner cutter 50 is urged against the outer shearing foil 30 by a bias of the spring 70 which is weaker when the inner cutter 50 moves to the angularly displaced end positions than when the inner cutter 50 is at the neutral position of FIG. 3, in which the axle 57 is depressed into the groove 63 to the greatest extent. It should be noted that as the axle 57 move along the groove 63, the swell 56 is kept in contact with the recesses 67 of the lips 65 so that the inner cutter 50 receives at this point of contact from the drive arm 60 a driving force for reciprocation thus defining a drive point which is above the connection point of the stem 55 with the drive arm 60. With this varying biasing force applied to urge the inner cutter 50 against the outer shearing foil 30, the inner cutter 50 is well prevented from jamming with the outer shearing foil 30 and because the moving speed of the inner cutter 50 decreases as it advances to either of the opposite end positions, the biasing force is lowered correspondingly but at a level high enough to keep the inner cutter in hair shearing contact with the outer shearing foil 30. In other words, the biasing force decreases with the decreasing moving speed of the inner cutter 50 to avoid the jamming of the inner cutter 50 with the outer shearing foil 30, particularly when reaching either of the angularly displaced end positions. As a consequence, the biasing force becomes greatest when the inner cutter 50 is at the neutral position of FIG. 3, at which the moving speed of the inner cutter 50 reaches maximum to compensate for the biasing force in a sense of avoiding the jamming. Further, the inner cutter 50 is made tiltable about the swell 56 within a limited angular range in a plane including the X-axis so that all the blades 52 are kept into close contact with the outer shearing foil 30 while the inner cutter 50 reciprocates along the curvature of the outer shearing foil 30 as being continuously displaced in the longitudinal direction of the drive arm 60. In this manner, smooth shaving is successfully made with the arcuately contoured cutter.

It is noted in this connection that when considering a distance R2 measured from the axis of the pivot pin 61 to an upper end of the blade 52 at the longitudinal center of the inner cutter 50 at its neutral position of FIG. 3, the arcuate contour of the inner cutter 50 would follow an arcuate path having a radius of R2 as the drive arm 60 pivots in the absence of the coil spring 70 urging the inner cutter 50 radially outwardly, and such virtual arcuate path is parallel with the arcuate path along which the upper end of the drive arm 60 traces. The distance or radius R2 of the virtual curvature is selected to be less than the radius R1 of curvature for the outer shearing foil 30 and satisfy the following relation:

$$0.5<R2/R1(<1)$$

The above relation is found experimentally to be essential for smoothly sliding the inner cutter 50 along the arcuate outer shearing foil 30, particularly, in the direction of moving the inner cutter 50 from the end positions to the neutral position. When R2 is selected to be considerably less than R1, i.e., the upper end of the drive arm 60 traces the correspondingly arcuate path having a radius considerably less than R1, the drive force F acting along a tangent of the correspondingly greater curvature for moving the inner cutter towards the neutral position is also applied to the outer shearing foil 30 at a greater angle, thereby unduly increasing the friction between the inner cutter 50 and the outer shearing foil 30 or even damaging the blades 52 and the foil 30. In order to avoid this problem, experiments have been made with differing ratios of R2/R1 and reveal that the above relation R2/R1>0.5 is essential for assuring smooth sliding movement of the inner cutter from the end positions to the neutral position, in addition to the movement from the neutral position to the end positions.

Figure 7:
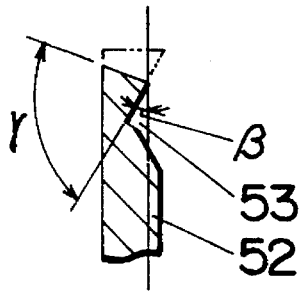
FIG. 7 is an enlarged view of a portion of inner blades forming the inner cutter.

As shown in FIG. 6, the blades 52 of the inner cutter 50 are each formed with an undercut 53 and are mounted on the base 51 in such a manner that the blades 52 on either side of the longitudinal center of the inner cutter have the individual undercuts 53 directing outwardly. Initially, the blades 52 are mounted upright on the base 51 to define an arcuate contour, i.e., an envelop passing through the tips of the blades 52, as indicated by a line E in FIG. 6. Thereafter, the blades 52 are sharpened along a curvature, as indicated by C in the figure, having a uniform radius R1. The sharpening of the blades 52 is made to extend to upper portions of the undercuts 53 but not to the bottoms thereof for removing the upper end of the undercut portion of the blades 52, as shown in FIG. 7. The undercut 53 is made to give a clearance angle B which is greater than an angle e for the tip of each blade 52 on the curvature having the radius R1 between a plane passing through the tip and the axis of the pivot pin 61 and a normal plane passing through a center of the inner cutter 50 and the axis of the pivot pin 61. With thus angled undercut 53, it is possible to give a cutting edge angle $\gamma$ which is less than 90°. Without the undercut 53, the blades remote from the center of the inner cutter would have a cutting edge angle of more than 90° when the blades are sharpened along the curvature C, which would worsen the cutting performance of such blades. In contrast, the illustrated inner cutter 50 is made to assure good cutting effect even at the outermost blades 52 for smooth shaving.

Figure 8:
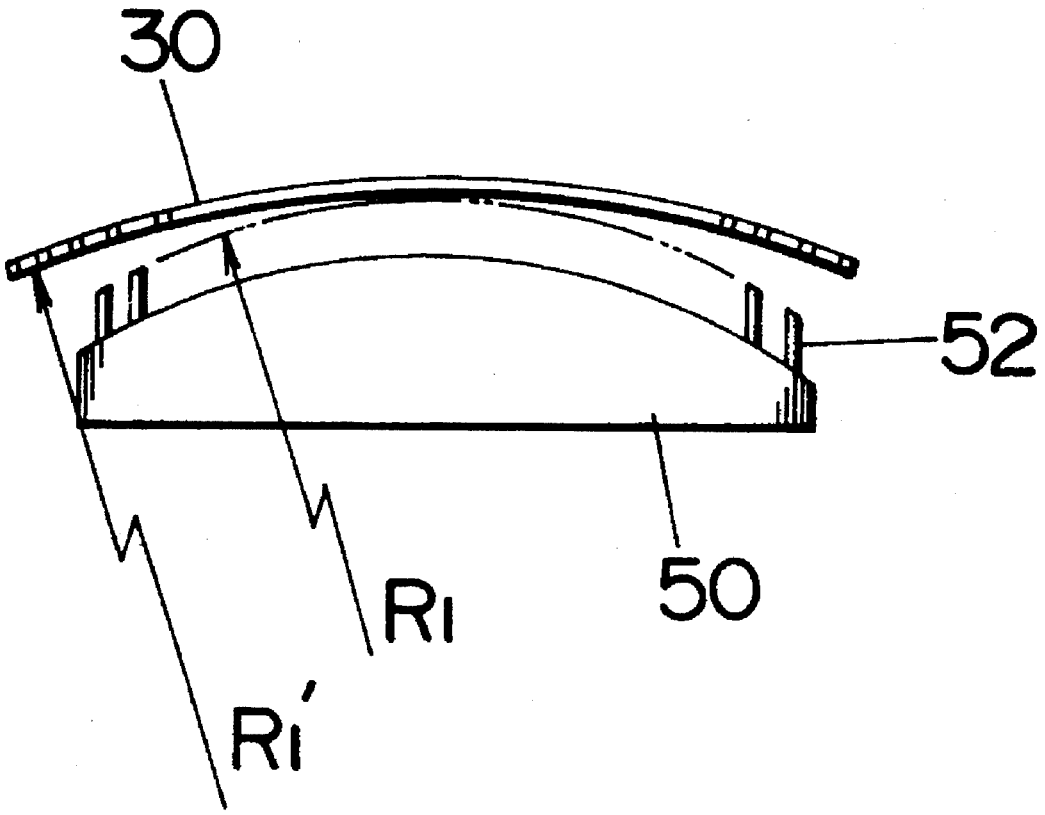
FIG. 8 is a schematic view illustrating the outer shearing foil in its initially curved condition before being further curved into a predetermined curvature along the inner cutter.

As schematically shown in FIG. 8, the outer shearing foil 30 is formed initially to have an arcuate curvature having a radius R1' greater than the radius R1 of curvature for the inner cutter 50. Thereafter, the outer shearing foil 30 is curved along the curvature having the radius R1 so as to be in exact conformity with the arcuate contour of the inner cutter 50, enabling the inner cutter 50 to move in uniform contact with the outer shearing foil 30. It should be noted in this connection that as the outer shearing foil 30 is shaped to have the curvature in conformity with the arcuate contour of the inner cutter 50 from less curvature, i.e., having the greater radius R1' of curvature, the opposite end portions of the outer shearing foil 30 more readily flex outwardly than the center portion. With this result, the biasing force for urging the inner cutter against the outer shearing foil 30 is further weakened at the opposite end portions of the outer shearing blade 30, which ensures to prevent the jamming of the inner cutter 50 against the opposite end portions of the outer shearing foil 30, in addition to the effect of reducing the biasing force acting on the inner cutter from the coil spring 70.

In order to further prevent the jamming of the inner cutter 50 at the opposite end thereof against the outer shearing foil 30, the inner cutter 50 is designed to lower a resistance or drag acting to the leading blade 52 at one end of the inner cutter 50 from the outer shearing foil 30 when moving outwardly in one direction. The resistance or drag D1 that the leading blade 52 at the end of the inner cutter 50 receives from the outer shearing foil 30 can be expressed by the following equation:

$$D1=P/2+HF/B(>0)$$

wherein P is the biasing force urging the inner cutter 50 against the outer shearing foil 30, H is a height measured from the upper end of the outermost blade 52 to a drive point at which the drive arm 60 transmits a drive force for reciprocating the inner cutter 50, F is the drive force, and B is a length between the two outermost blades 52. In this embodiment, H/B is selected to be 0.3 or less in order to reduce the resistance D1. Thus reduced resistance ensures to prevent the jamming of the inner cutter 50, in combination with the effect that the biasing force P decreases as the inner cutter 50 moves from its neutral position to the opposite end positions and also that the outer shearing foil 30 readily flexes outwardly at the opposite end portions. When the leading blade 52 receives the resistance D1, the trailing blade 52 at the opposite end of the inner cutter with respect to the moving direction thereof receives a resistance D2 from the outer shearing foil 30, which resistance D2 is expressed by the following equation:

$$D2=P/2-HF/B(>0)$$

Thus, the inner cutter 50 receives the resistances D1 and D2 respectively at the opposite ends of which difference is 2H/B. It is found that, when the difference becomes greater, the inner cutter 50 is likely to be lifted at the trailing end and fail to keep smooth contact with the outer shearing foil 30. In due consideration of this and to prevent such undesired lifting of the inner cutter 50, H/B is selected to be 0.3 or less to minimize the above difference. When the outer shearing foil 30 is selected to have the radius R1 of curvature which is less than 35 mm, H/B is preferred to be less than 0.2. The above relation H/B<0.3 is consistently realized by the unique coupling between the inner cutter 50 and the drive arm 60 as discussed hereinbefore. That is, as best seen in FIG. 3, the height H is considerably reduced by the design in which the drive point of transmitting the reciprocation force F to the inner cutter 50 from the drive arm 60 is located deep within the inner cutter 50. For this purpose, the swell 56 at which the inner cutter 50 receives the drive force F is formed interior of the base 51 of the inner cutter 50 and upwardly of the axle 57 at which the inner cutter 50 is floatingly connected to the drive arm 60.

Figure 12:
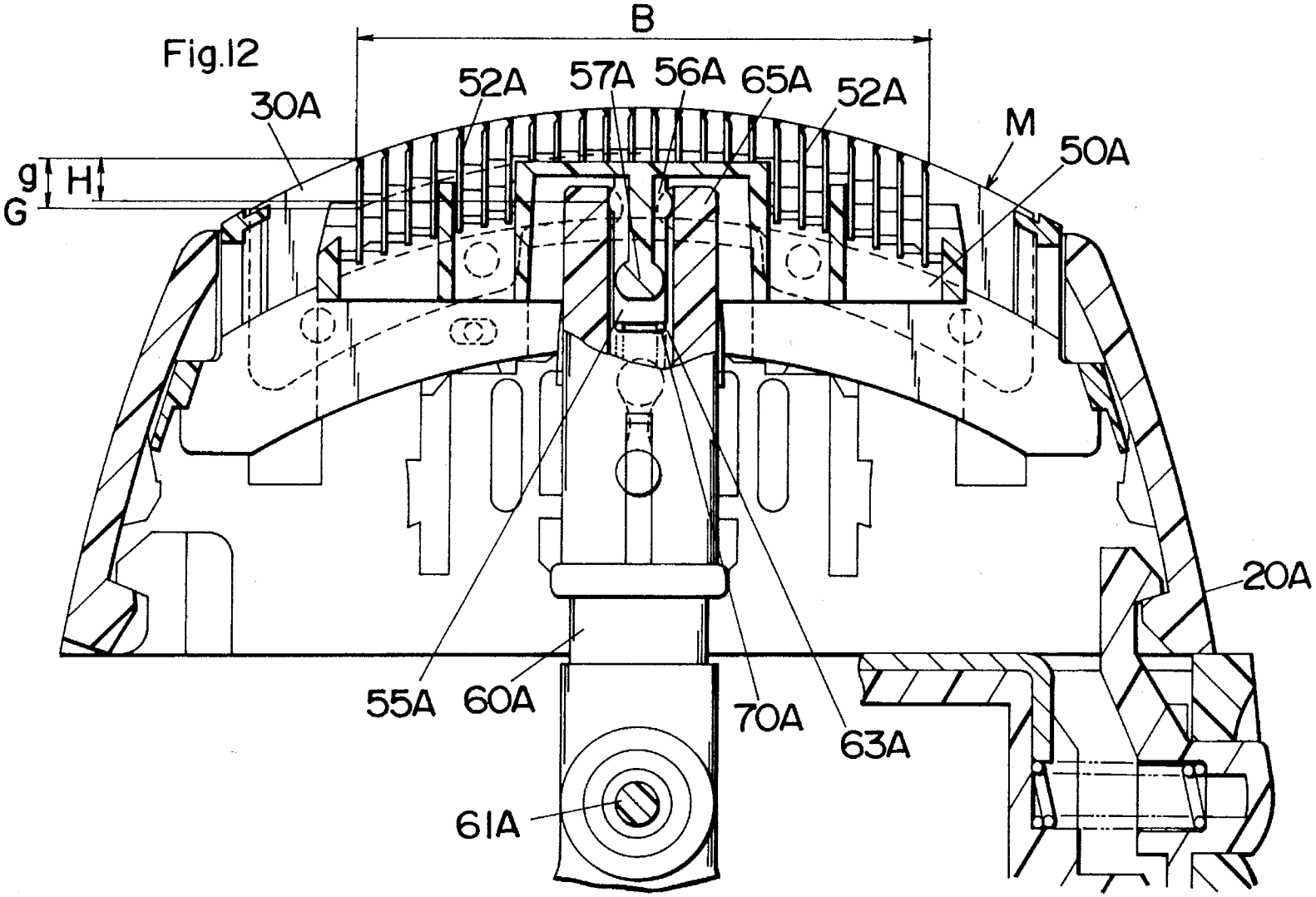
FIG. 12 is a sectional view of a cutter head in accordance with a modification of the above embodiment.

FIG. 12 illustrates a modification of the above embodiment which is similar to the above embodiment except that the height H is further reduced by providing the drive point further deep into the inner cutter 50A. Like elements are designated by like numerals with a suffix letter of "A" and no duplicate explanation is made herein for the sake of simplicity. With this configuration, the drive point at which the swell 56A of the inner cutter 50A receives the driving force F is spaced vertically upwardly from a point G where the lower end of the outermost blade 52A is in contact with the outer shearing foil 30A, which point is shown as lowered by a vertical distance g from the upper end of the outermost blade 52A. It is also found that the above relation H<g is mostly effective for preventing the above-mentioned jamming and lifting of the inner cutter.

Figure 9:
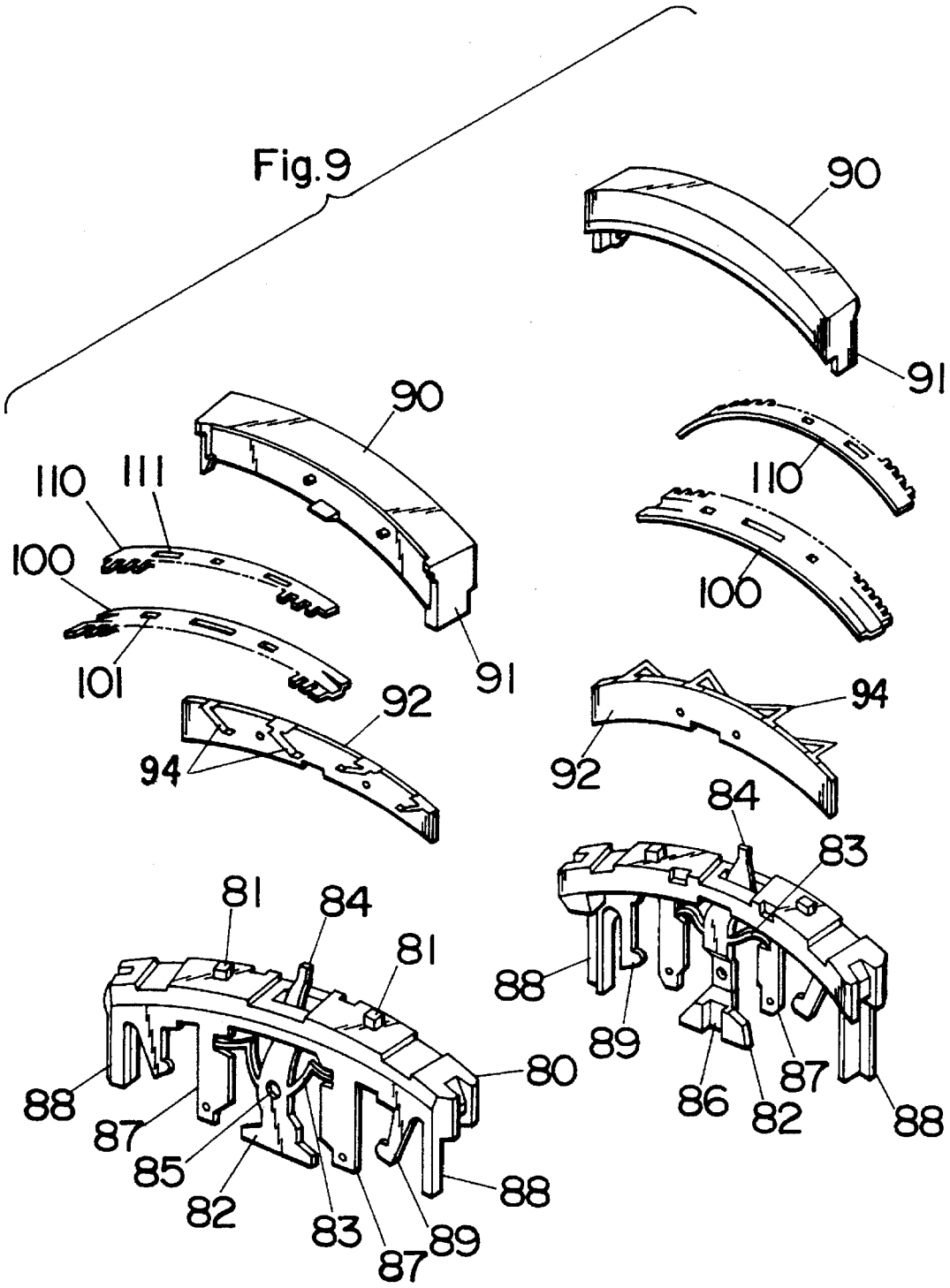
FIG. 9 is an exploded perspective view of trimmers provided on both sides of the cutter head.
Figure 10:
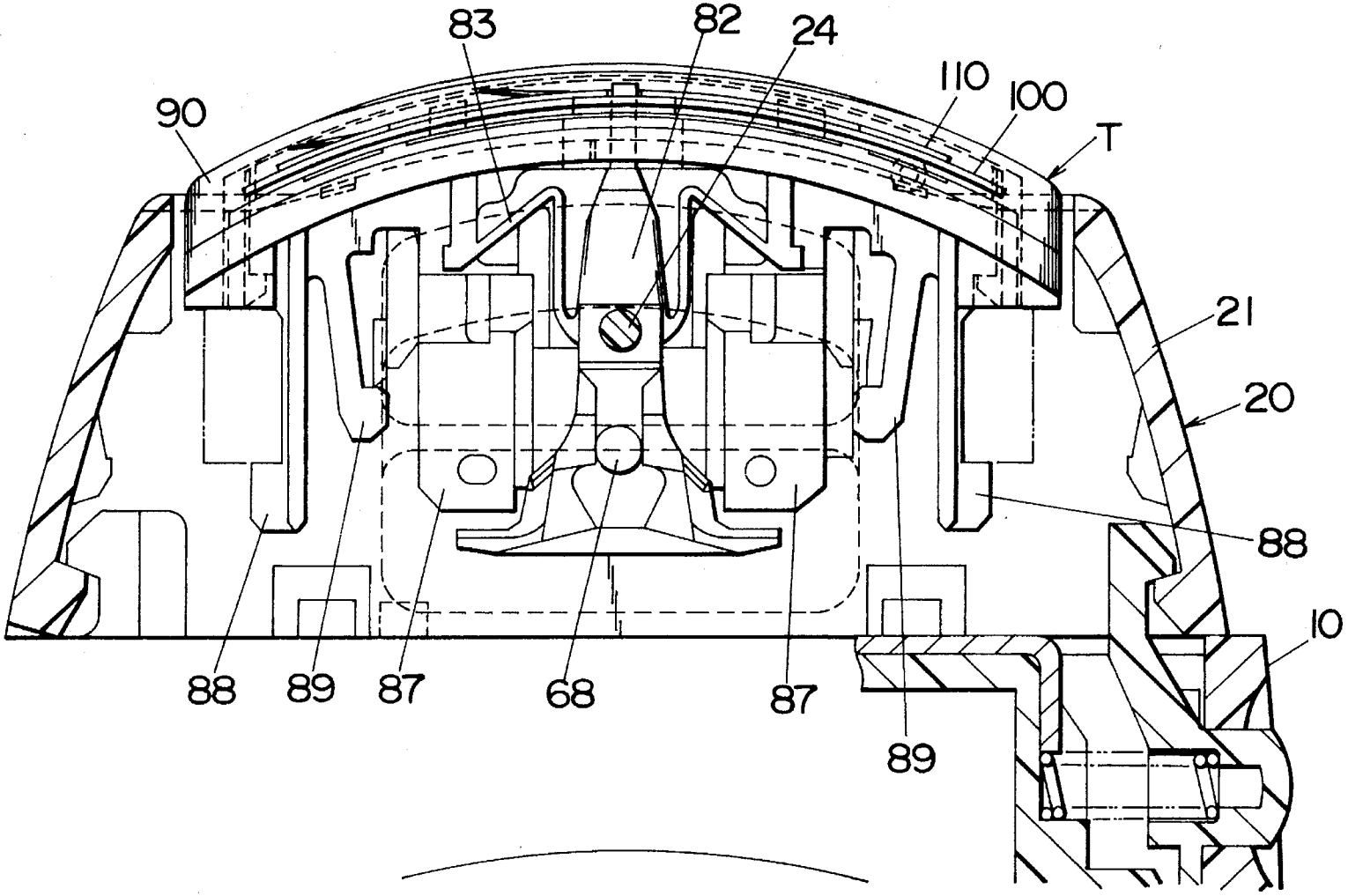
FIG. 10 is a front section of the cutter head illustrating a driving mechanism for the trimmer.

Referring to FIG. 9, the trimmer T comprises a plastic frame 80 with an arcuate top face on which the toothed stationary blade 100 is fixedly mounted by engagement of bosses 81 on the frame 80 with corresponding holes 101 in the blade 100. The toothed movable blade 110 is slidably mounted on the frame 80 over the stationary blade 100 with the bosses 81 extending into corresponding slots 111 in the blade 110. A cover 90 is fitted over the blades on the frame 80 by engagement of hooks 91 to the opposite end of the frame so as to exposes only the toothed edges of the blades. Fixedly interposed between the cover 90 and the side face of the frame 80 is a retainer plate 92 with a plurality of springs 94 which rest on and urge the movable blade 110 downwardly to give a suitable contacting pressure between the blades 100 and 110. The frame 80 includes a trimmer drive lever 82 which is connected through resilient arms 83 to a pair of props 87 depending from the frame 80 so that the drive lever 82 is movable relative to the frame 80. The drive lever 82 is formed at its upper end with a finger 84 which extends through the stationary blade 100 and is fixed to the center of the movable blade 110. The drive lever 82 is formed in its longitudinal center with a pivot hole 85 which receives a pin 24 projecting inwardly from the head frame 21 so that the drive lever 82 is pivotable about the pin 24. Formed at the lower end of the drive lever 82 is a groove 86 which receives one of the first and second pins 68 and 69 projecting on the drive arm 60 for the main cutter M so that the drive lever 82 is driven to reciprocate together with the drive arm 60. Thus, the movable blade 110 is driven through the drive lever 82 to reciprocate in contact with the stationary blade 100 for trimming of hairs between the toothed edges thereof. The frame 80 is also formed with a pair of end bars 88 depending from the opposite ends thereof and with a pair of hooks 89 depending inwardly of the end bars 88. The frame 80 is molded from a plastic material into a unitary structure including the trimmer drive lever 82, resilient arm 83, props 87, end bars 88, and the hooks 89.

Thus constructed trimmer T is assembled into the head frame 21 by engagement of the props 87 and the end bars 88, respectively with corresponding catches 27 and 28 formed interiorly of the head frame 21, as seen in FIG. 2, while the hooks 89 are engaged with projections 29 on one side of the catches 27. One of the trimmers is vertically slidable relative to the head frame 21 and is connected to a slider handle 25 mounted on the exterior of the head frame 21. As best shown in FIG. 4, the slider handle 25 has an inward extension 26 which projects through an opening 74 in the head frame 21 and is formed with the pin 24 for connection into the pivot hole 85 of the drive lever 82. Although not shown in the figures, the slider handle 25 has a pair of hooks extending into the head frame 21 for connection with the lower ends of the props 87. As shown in FIG. 4, the slidable trimmer T is normally held in the lowered position the same as the other fixed trimmer T, at which position the first pin 68 of the drive arm 60 engages into the groove 86 of the drive lever 82. A distance L1 between the pin 24 and the pin 68 is selected to be shorter than a distance L2 between the pin 24 and a point of engagement between the finger 84 and the movable blade 110, which compensates for a short distance between the pin 68 and the pivot pin 61 along the length of the drive arm 60, thereby assuring to reciprocate the movable blade 110 a sufficient distance for trimming operation. When the slidable trimmer T is moved to an extended position where the cutting edge thereof projects above the top of the main cutter M, the second pin 69 comes into engagement with the groove 86 while the first pin 68 escapes out of the groove 86, thereby the drive lever 82 is still operative to reciprocate the movable blade 110. In this connection, a distance E between the first and second pins 68 and 69 is selected to be less than a vertical displacement of the trimmer T in order to minimize the reduction in the amount of reciprocation for the movable blade 110 at this extended position.

Figure 11A:
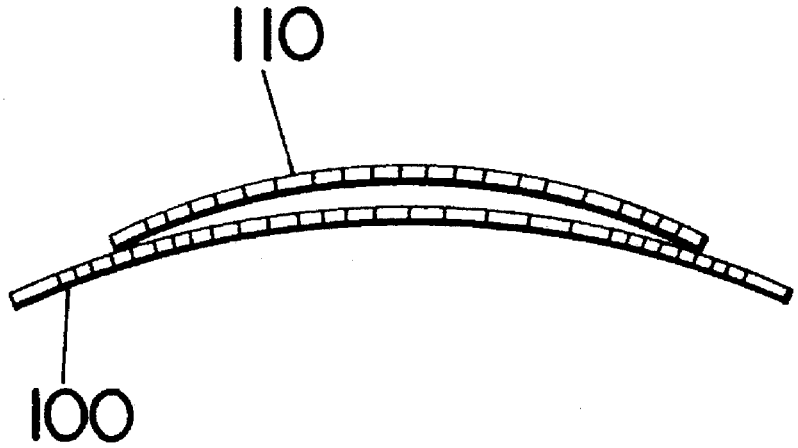
FIGS. 11A to 11C are schematic views illustrating fixed and movable blades for the trimmer, respectively.
Figure 11B:
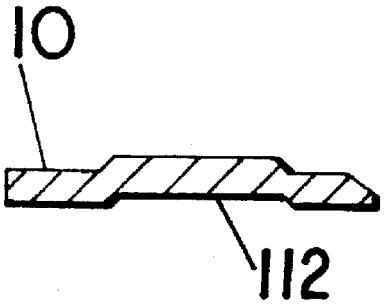
Figure 11C:
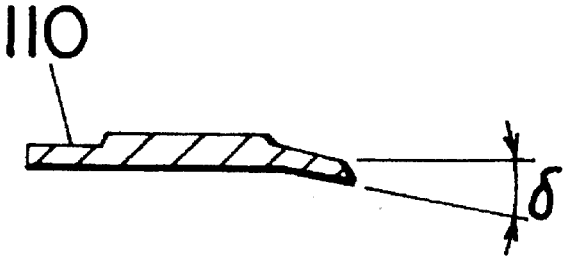

As schematically shown in FIG. 11A, the movable blade 110 has an initial curvature greater than that of the stationary blade 100, and is further curved when assembled over the stationary blade 100 by being depressed thereover. Whereby, the movable blade 101 can well conform to the curvature of the stationary blade 100, which curvature is substantially equal to that of the main cutter M. The movable blade 110 is preferred to have an initial cross section with a recess 112 in its bottom, as shown in FIG. 11B, when formed to have the initial curvature, after which the bottom including the recess is removed, as shown in FIG. 11C, so as to be readily curved along the stationary blade 100. When removing the bottom of the movable blade 110, the toothed edge of the movable blade 110 is finished to give a cutting surface inclined at an angle δ so that the cutting edge of the movable blade 111 comes into intimate contact with the edge of the stationary blade 100 for successfully trimming of the hairs therebetween. In this connection, the stationary blade 100 is formed to have a cross section such that the stationary blade 100 is in sliding contact with the movable blade 110 only at the toothed edges and the end opposite of the edges for reducing a friction therebetween.

When moving the cutter head across the skin of the user, the fixed trimmer T and the slidable trimmer T in the lowered position cooperate with the main cutter M in such a manner that the leading one of the trimmer T with respect to the moving direction of the cutter head is first to cut relatively long hairs to short length, which is cut immediately subsequently by the main cutter M following the leading trimmer M. Thus, the trimmers T cooperate with the main cutter M to effect close shaving over a restricted area such as underarms. To this end, the trimmer T defines a cutting edge which is curved in conformity with the curvature of the outer shearing foil 30 and is spaced downwardly from the ridge line of the outer shearing foil 30 by a uniform distance D, as shown in FIG. 4. Further for the trimmers T, the distance L2 between the pin 24 and the point of engaging the finger 84 with the movable blade 110 is selected to be considerably less than the radius of curvature for the cutting plane between the blades 100 and 110. With this arrangement, when transmitting a drive force for reciprocating the movable blade 110, the finger 84 engages with the movable blade 110 always at an angle of 90° or more with respect to the surface of the movable blade 110 so that the finger 84 will not force the movable blade 110 down onto the stationary blade 110, and therefore enables the movable blade 110 to move smoothly along the stationary blade 100 without causing a possibility of clamping the movable blade 110 between the finger 84 and the stationary blade 100. Such clamping would be otherwise occur when the finger 84 engages at an angle of less than 90° with respect to the surface of the movable blade.

What is claimed is:

1. A dry shaver which comprises:

a housing mounting thereon a cutter head comprising a perforated outer shearing foil and an inner cutter, said outer shearing foil having a first axis and curved arcuately along said first axis, said inner cutter having a longitudinal axis and having an arcuate contour curved along said longitudinal axis in conformity with said outer shearing foil;

a drive arm extending from said housing and connected to reciprocate said inner cutter along a reciprocation path including said first axis and being in hair shearing engagement with said outer shearing foil so that said inner cutter moves to and fro past a neutral position between two opposite end positions which are spaced along said reciprocation path;

said drive arm connected at an upper end thereof to said inner cutter and pivotally supported at a portion downwardly of said upper end to define thereat a pivot axis extending perpendicular to said reciprocation path, said drive arm being connected at a lower end thereof to a drive source so as to oscillate about said pivot axis with said upper end tracing an arcuate path having a curvature greater than the curvature of said outer shearing foil;

said inner cutter being connected to said drive arm to be slidable along a length of said drive arm as well as to be pivotable relative thereto within a limited angular range in a plane including said reciprocation path;

spring means floatingly supporting said inner cutter to said drive arm for biasing said inner cutter against said outer shearing foil;

said inner cutter being arranged to satisfy the following relation:

$$0.5<R2/R1<1$$

wherein R1 is a radius of curvature of the outer shearing foil, and R2 is a distance between said pivot axis of said drive arm and a point at which an upper end of said inner cutter in said neutral position is in contact with said outer shearing foil, whereby said spring means exerts a lower biasing force to said inner cutter when said inner cutter moves toward said end position than at said neutral position.

2. A dry shaver as set forth in claim 1, wherein said inner cutter comprises a plurality of inner blades which are spaced along said longitudinal axis with individual edges of said blades which to define said arcuate contour, and wherein said inner cutter has a length (B) extending from one to the other of outermost inner blades and has a height (H) measured from an upper end of the outermost inner blade to a drive point at which said drive arm transmits a drive force for reciprocating said inner cutter, said length (B) and height (H) being determined to satisfy the relation that H/B is 0.3 or less.

3. A dry shaver as set forth in claim 1, wherein said inner cutter has a drive point at which said drive arm transmits a drive force for reciprocating said inner cutter, said drive point being located upwardly of a connection point at which said inner cutter is slidably connected to said drive arm.

4. A dry shaver as set forth in claim 1, wherein said inner cutter comprises a plurality of inner blades which are spaced along said longitudinal axis with individual edges which to define said arcuate contour, and wherein said inner cutter has a drive point at which said drive arm transmits a drive force for reciprocating said inner cutter, said drive point being located upwardly of a contact point at which a lower end of the edge of the outermost inner blade contacts with said outer shearing foil.

5. A dry shaver which comprises:

a housing mounting thereon a cutter head comprising a perforated outer shearing foil and an inner cutter, said outer shearing foil having a first axis and curved arcuately along said first axis, said inner cutter having a longitudinal axis and having an arcuate contour curved along said longitudinal axis in conformity with said outer shearing foil;

a drive arm extending from said housing and connected to reciprocate said inner cutter along a reciprocation path parallel to said first axis in hair shearing engagement with said outer shearing foil so that said inner cutter moves to and fro across a neutral position between two opposite end positions which are spaced along said reciprocation path;

spring means floatingly supporting said inner cutter to said drive arm for biasing said inner cutter against said outer shearing foil, said spring means exerting a lower biasing force to said inner cutter when said inner cutter moves to said end position than at said center position; and said inner cutter comprising a plurality of inner blades which are spaced along said longitudinal axis with individual edges of said blades being cooperative to define said arcuate contour, said inner cutter having a length (B) between two outermost inner blades and having a height (H) measured from an upper end of the outermost inner blade to a drive point at which said drive arm transmits a drive force for reciprocating said inner cutter, said length (B) and height (H) being determined to satisfy the relation that H/B is 0.3 or less.

6. A dry shaver as set forth in claim 5, wherein said drive point is located upwardly of a connection point at which said inner cutter is slidably connected to said drive arm.

7. A dry shaver as set forth in claim 5, wherein said drive point is located upwardly of a contact point at which a lower end of the edge of the outermost inner blade contacts with said outer shearing foil.

* * * * *